United States Patent [19]

Suzuki et al.

[11] Patent Number: 4,475,512

[45] Date of Patent: Oct. 9, 1984

[54] AIR-FUEL RATIO CONTROL SYSTEM

[75] Inventors: Hitoshi Suzuki, Niiza; Kazuo Hara, Musashino, both of Japan

[73] Assignee: Fuji Jukogyo Kabushiki Kaisha, Tokyo, Japan

[21] Appl. No.: 349,548

[22] Filed: Feb. 17, 1982

[30] Foreign Application Priority Data

Feb. 17, 1981 [JP] Japan ..... 56-22076

[51] Int. Cl.[3] ..... F02M 7/20

[52] U.S. Cl. ..... 123/440

[58] Field of Search ..... 123/440, 489; 60/276, 60/285

[56] References Cited

U.S. PATENT DOCUMENTS

| | | | |
|---|---|---|---|
| 4,136,645 | 1/1979 | Ito et al. | 123/440 |
| 4,320,731 | 3/1982 | Braun et al. | 123/440 |
| 4,364,356 | 12/1982 | Gerhold | 123/440 |
| 4,378,773 | 4/1983 | Ohgami | 123/440 |

*Primary Examiner*—Tony M. Argenbright

*Attorney, Agent, or Firm*—Martin A. Farber

[57] ABSTRACT

An air-fuel ratio control system for an internal combustion engine comprises an exhaust passage, a carburetor, an on-off type electromagnetic valve for correcting the air-fuel ratio of the air-fuel mixture supplied to the cylinder and an $O_2$-sensor for detecting the oxygen concentration of the exhaust gases, a catalytic converter provided in the exhaust passage, and a feedback control circuit responsive to the output of the $O_2$-sensor for producing pulses for driving the electromagnetic valve for correcting the air-fuel ratio. The $O_2$-sensor is provided at a position downstream of the catalytic converter such that the volume of the exhaust passage from an inlet of the exhaust passage to the position is substantially twice as much as the volume from the inlet to an inlet of the catalytic converter. The feedback control circuit comprises a differentiating circuit for differentiating the output of the $O_2$ sensor and a microcomputer. The microcomputer operates in dependency on the output of the differentiating circuit for driving the on-off type electromagnetic valve.

4 Claims, 13 Drawing Figures

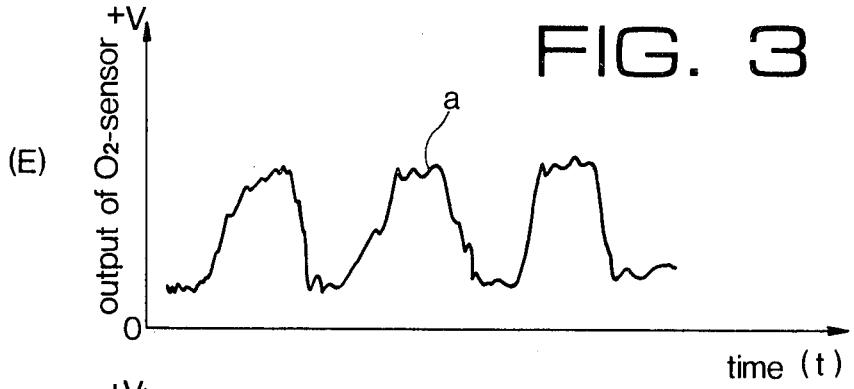
FIG. 3
(E)
+V
output of O2-sensor
a
0
time (t)
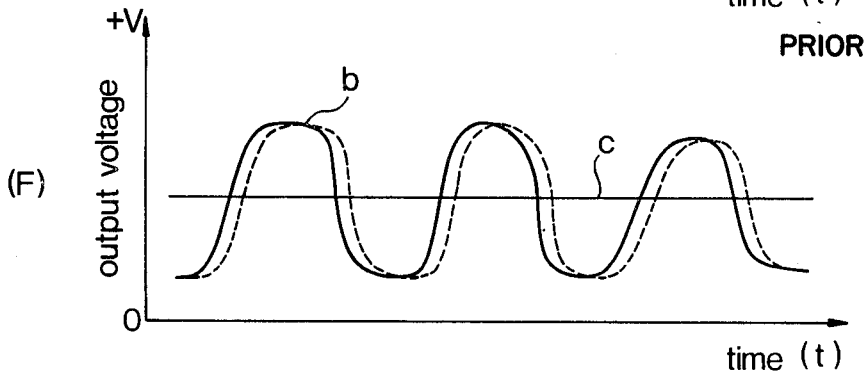
PRIOR ART
(F)
+V
output voltage
b
c
0
time (t)
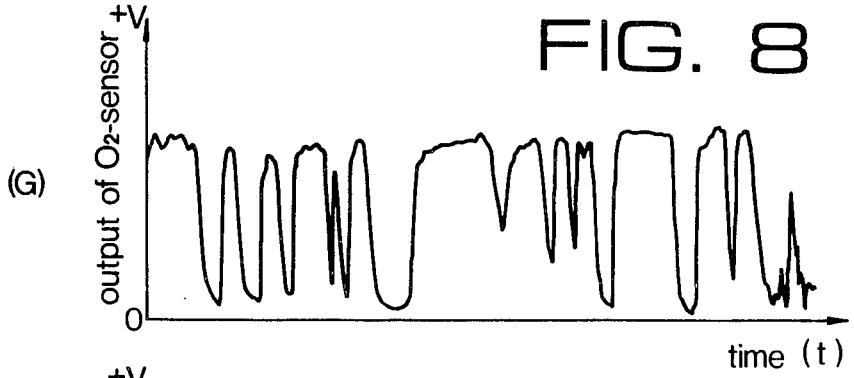
FIG. 8
(G)
+V
output of O2-sensor
0
time (t)
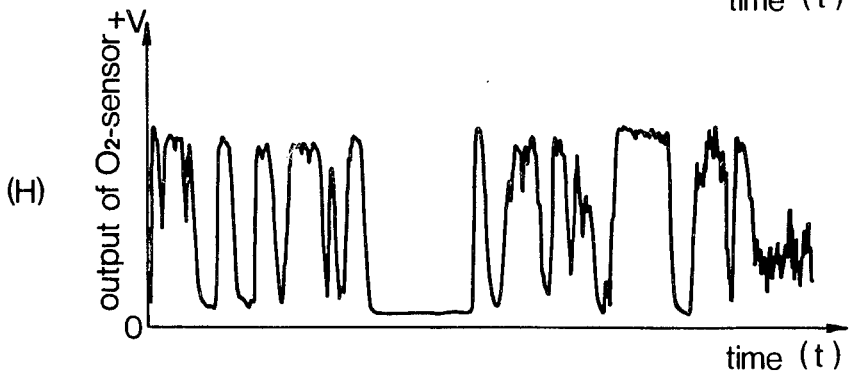
(H)
+V
output of O2-sensor
0
time (t)

AIR-FUEL RATIO CONTROL SYSTEM

BACKGROUND OF THE INVENTION

The present invention relates to an air-fuel ratio control system for an internal combustion engine, which controls the air-fuel ratio of air-fuel mixture to a value approximately equal to the stoichiometric air-fuel ratio at which a three-way catalyst acts most effectively.

In a conventional air-fuel ratio control system, the air-fuel ratio of air-fuel mixture burned in cylinders of engine is detected as oxygen concentration of exhaust gases by means of an $O_2$-sensor provided in the exhaust passage of the engine at a position upstream of a catalytic converter, and a comparator compares the output signal from the $O_2$-sensor with a reference value which is fed from a middle value detecting circuit and produces an output representing whether the signal is greater or smaller than the reference value corresponding to the stoichiometric air-fuel ratio. An electromagnetic value is operated in dependency on the output for regulating the air to be mixed with the mixture to provide the stoichiometric air-fuel ratio.

In such a control system, the output of the $O_2$-sensor includes noise and the waveform of the output does not have a steep variation. Therefore, in order to control the air-fuel ratio with a microcomputer, a filter and an A/D converter must be provided between the $O_2$-sensor and the microcomputer. Accordingly, the system becomes complicated in construction.

SUMMARY OF THE INVENTION

The object of the present invention is to provide an air-fuel ratio control system which may be easily and simply constructed as a digital control system with a microcomputer.

According to the present invention, there is provided an air-fuel ratio control system for an internal combustion engine having an exhaust passage, a carburetor, an electromagnetic valve for correcting the air-fuel ratio of the air-fuel mixture supplied to the cylinder, an $O_2$-sensor for detecting oxygen concentration of exhaust gases, a catalytic converter provided in the exhaust passage, and a feedback control circuit responsive to the output of the $O_2$-sensor for producing signals for driving the electromagnetic valve for correcting the air-fuel ratio, the improvement comprising the $O_2$-sensor being provided in the exhaust passage at a position downstream of the catalytic converter such that the volume of the exhaust passage from an inlet of the exhaust passage to the position is substantially twice as much as the volume from the inlet to an inlet of the catalytic converter, the feedback control circuit comprising a differentiating circuit for differentiating the output of the $O_2$-sensor and a microcomputer operating in dependency on the output of the differentiating circuit for actuating the electromagnetic valve.

The other objects and features are explained more in detail with reference to the accompanying drawings.

BRIEF DESCRIPTION OF THE DRAWINGS

FIGS. 3E–F shows waveforms at positions in the system of FIG. 2;

FIGS. 8G–H shows waveforms obtained in an experiment.

DETAILED DESCRIPTION OF THE PREFERRED EMBODIMENTS

Figure 1:
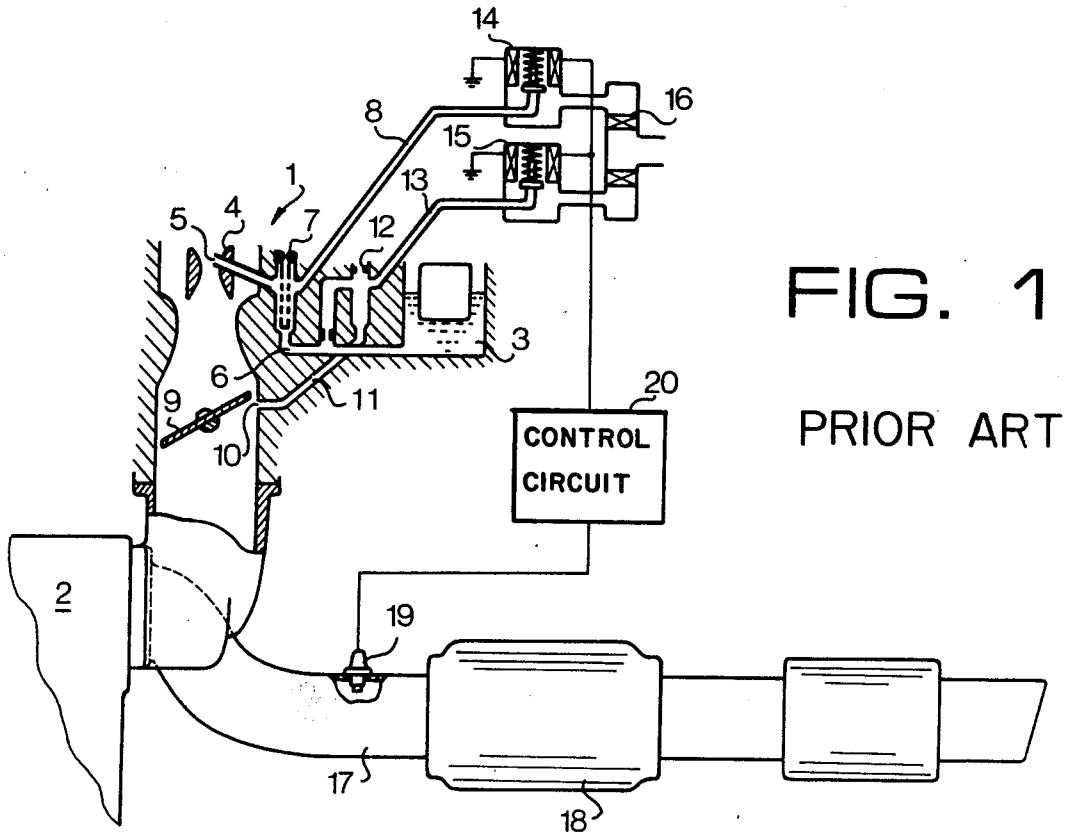
FIG. 1 PRIOR ART
FIG. 1 is a schematic view of a conventional air-fuel ratio control system.

Referring to FIG. 1 showing schematically a conventional air-fuel ratio control system, reference numeral 1 designates a carburetor provided upstream of an engine 2. The carburetor 1 comprises a float chamber 3, a main nozzle 5 of a venturi 4, and a correcting air passage 8 communicating with an air-bleed 7 which is provided in a main fuel passage 6 between the float chamber 3 and the nozzle 5. Another correcting air passage 13 communicates with another air-bleed 12 which is provided in a slow fuel passage 11 which diverges from the main fuel passage 6 and extends to a slow port 10 opening in the vicinity of a throttle valve 9. These correcting air passages 8 and 13 communicate with respective electromagnetic valves 14, 15, induction sides of which communicate with the atmosphere through an air cleaner 16. Further, a catalytic converter 18 with a three-way catalyst is provided in an exhaust passage 17 at the downstream side of the engine, and an $O_2$-sensor 19 is provided between the engine 2 and the converter 18 to detect the oxygen concentration of the exhaust gases representing the air-fuel ratio of the mixture burned in the cylinder of the engine.

A control circuit 20 is applied with the output from the $O_2$-sensor 19 to actuate the electromagnetic valves 14, 15 to open and close at a duty ratio depending on the output signal. The air-fuel ratio is made lean by supplying correcting air to the carburetor at a large feed rate and respectively the air-fuel ratio is made rich by reducing the correcting air supply.

Figure 2:
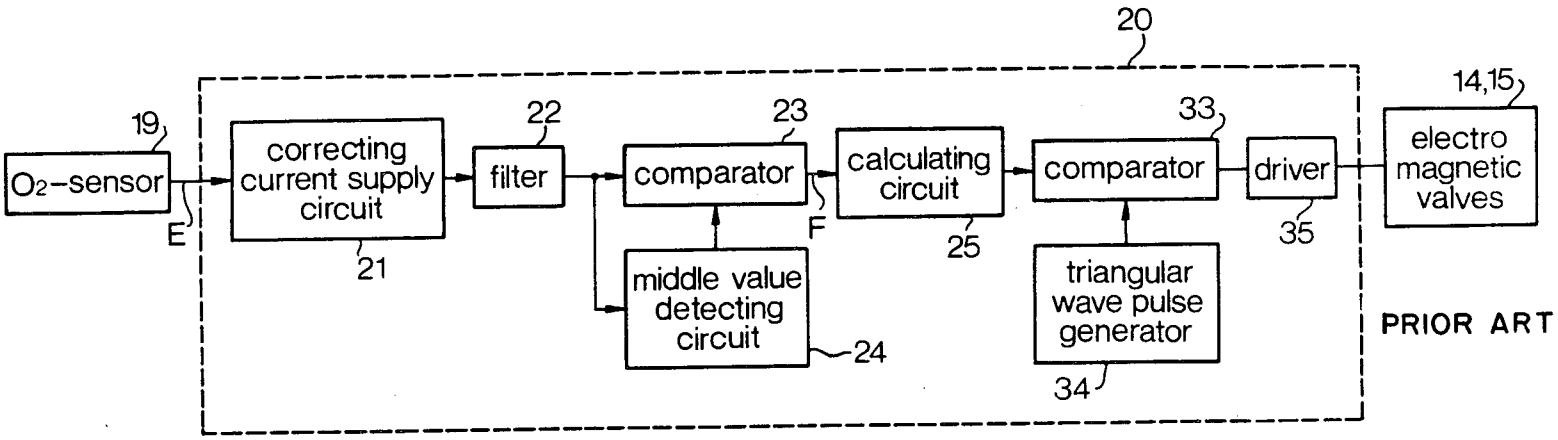
FIG. 2 is a block diagram showing the conventional air-fuel ratio control system.

Referring to FIG. 2 showing the control circuit 20, the output of the $O_2$-sensor 19 is connected to a correcting current supply circuit 21 for correcting the zero drift of the $O_2$-sensor 19. The output of the circuit 21 is connected to a filter 22. The output of the filter 22 is connected to a comparator 23 and a middle value detecting circuit 24. The output of the middle value detecting circuit 24 is applied to the comparator 23 as a reference voltage. The output of the comparator 23 is applied to a calculating circuit 25. The output of the calculating circuit 25 is applied to a comparator 33, and a triangular wave signal from a triangular wave pulse generator 34 is applied to the comparator 33 to produce square wave pulses. The comparator 33 is connected to a driver 35 and the output, in the form of square wave pulses, of the driver 35 is applied to the electromagnetic valves 14, 15.

The output signal of the $O_2$-sensor 19 varies rapidly at the stoichiometric air-fuel ratio. Accordingly, the output has waveforms shown in FIG. 3 by reference a. The waveforms are shaped by the circuit 21 and the filter 22 into waveforms b shown in FIG. 3. The output of the filter 22 is applied to the comparator 23, where the output signal of the filter 22 is compared with a middle value c fed from the middle value detecting circuit 24 for judging the air-fuel ratio of the mixture. The output of the comparator 23 is applied to the calculating circuit 25. The calculating circuit includes an integrator which produces an integrated output dependend on the output of the comparator 23. The output of the calculating circuit 25 is compared with the triangular pulse train from the triangular wave pulse generator 34 in the comparator 33 to produce the square wave pulses, the duty ratio of which varies with the integrated output of the calculating circuit 25. The square wave pulses are sent to electromagnetic valves 14, 15 through the driver 35. Accordingly, the electromagnetic valves 14, 15 are driven at the duty ratios of the square pulses. Thus, the air-fuel ratio of the mixture is controlled to the middle value c which is approximately equal to the stoichiometric air-fuel ratio.

It will be seen that the waveforms a in FIG. 3 have noise. The noise is caused by the fluctuation of the air-fuel ratio at every cylinder of the engine. In order to remove the noise, the filter 22 is provided.

Further, the waveforms b vary with gentle slope. The slope is decreased further as shown by the dashed waveform, when the character of the $O_2$-sensor worsens. Anyway, in order to control air-fuel ratio by a microcomputer with such a gentle waveform signal, the output of the comparator 23 must be converted to a digital signal by an A/D converter.

The present invention provides a control system which controls the air-fuel ratio by a microcomputer without the filter and A/D converter.

Figure 4:
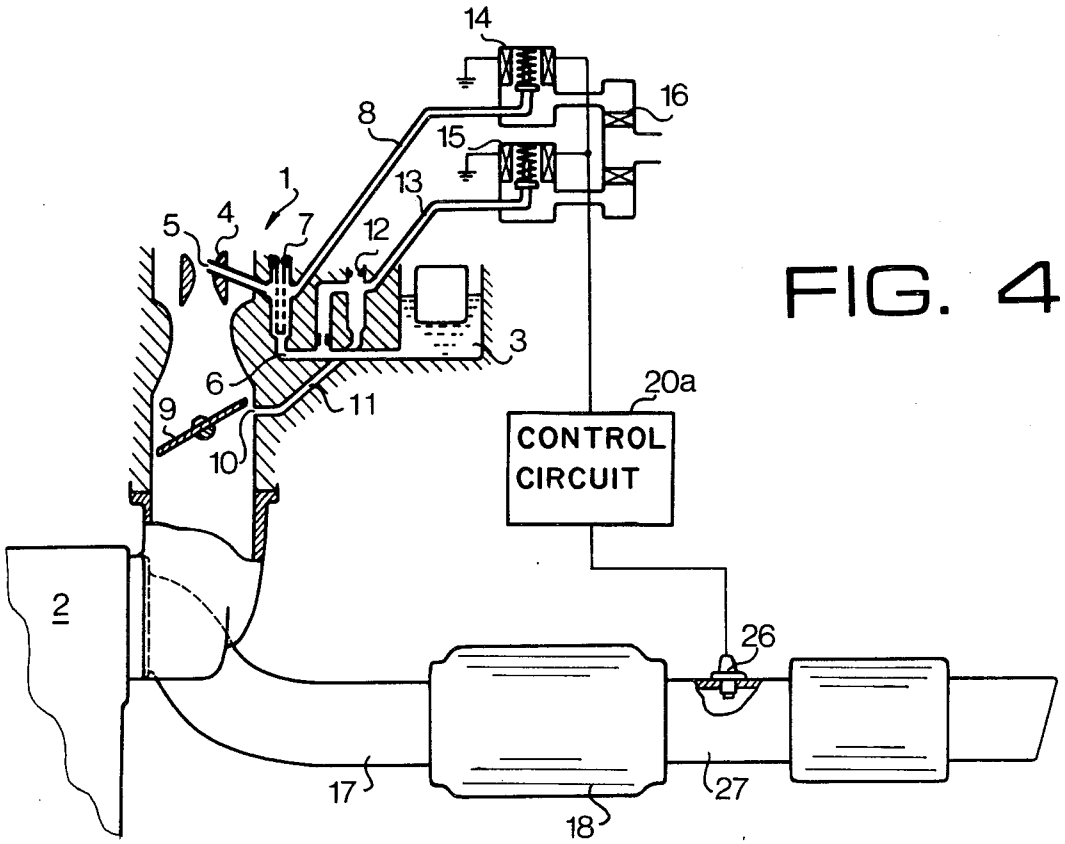
FIG. 4 is a schematic view of an air-fuel ratio control system according to an embodiment of the present invention.

Referring to FIG. 4 showing a system of the present invention, the same parts as in FIG. 1 are identified by the same reference numerals. An $O_2$-sensor 26 is provided at a position downstream of the catalytic converter 18. Therefore, the volume of the exhaust passage from exhaust ports of cylinders to the $O_2$-sensor 26 is increased more than the conventional system of FIG. 1. The output of the $O_2$-sensor 26 is connected to a control circuit 20*a*.

Figure 5:
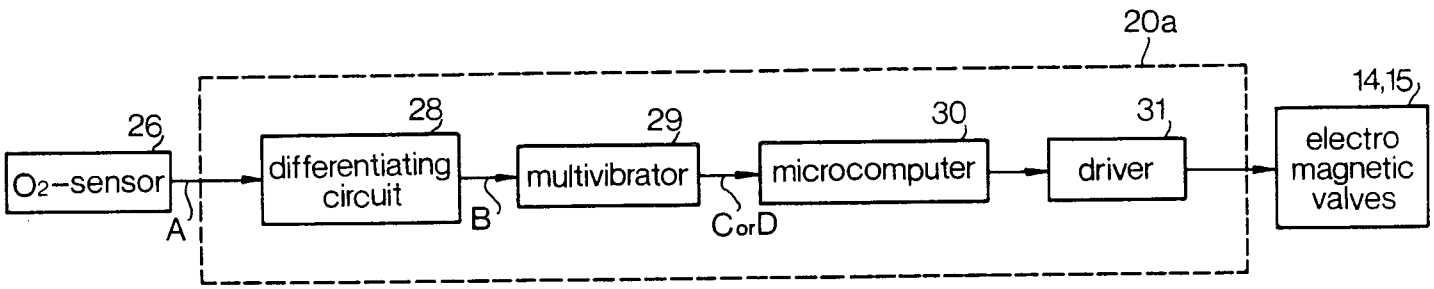
FIG. 5 is a block diagram of the control system of the same.

Referring to FIG. 5, the output of the $O_2$-sensor is applied to a differentiating circuit 28. The output of the differentiating circuit 28 is applied to a microcomputer 30 through a monostable multivibrator 29. The the output of the microcomputer is applied to the electromagnetic valves 14, 15 through a driver 31.

Figure 6:
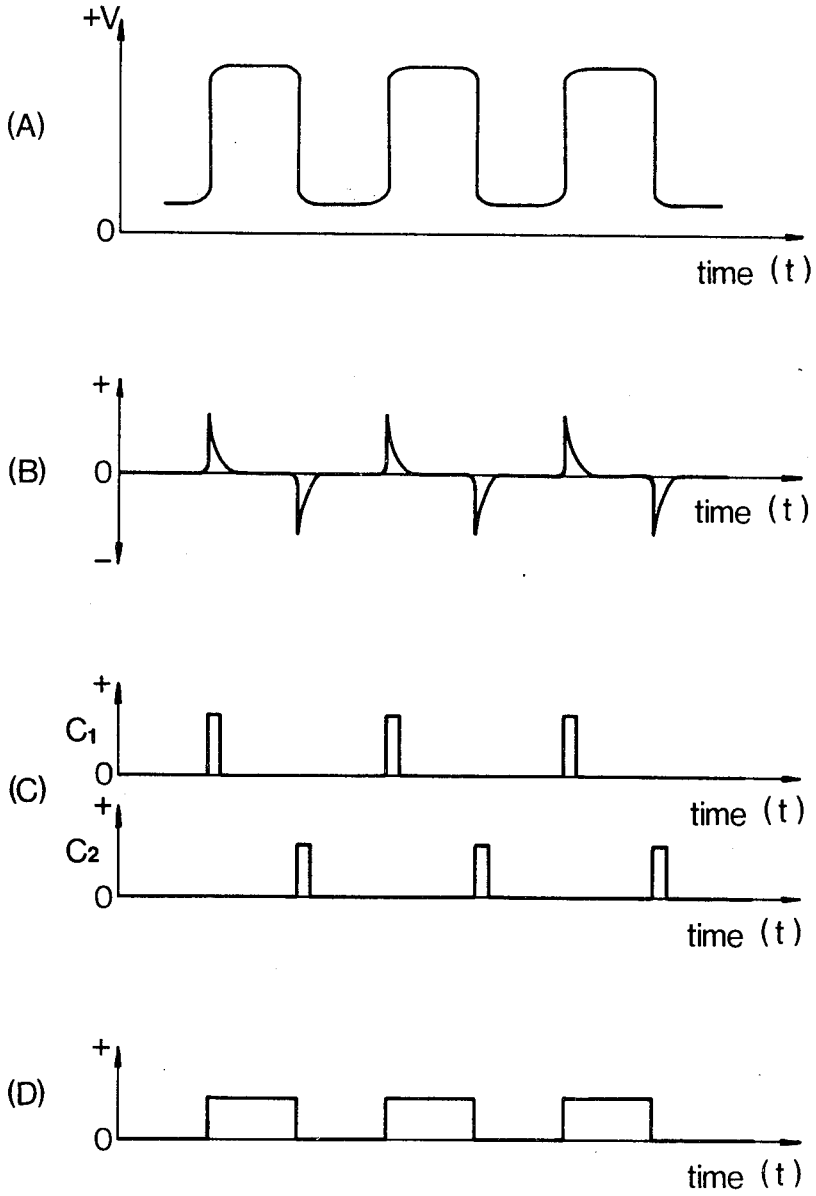
FIGS. 6A–D shows waveforms at various positions in FIG. 5.

The volume of the exhaust passage from the cylinders to the $O_2$-sensor is larger than that of the conventional system, whereby the above-described noises caused by the fluctuation of the air-fuel ratio at every cylinder are removed. Further, the exhaust gases after the catalytic converter 18 include a small amount of oxygen because of sufficient chemical reaction by catalyst. Therefore, the output of the $O_2$-sensor varies with a steep inclination at the value corresponding to the stoichiometric air-fuel ratio as shown in FIG. 6(A). Accordingly, when the output of the $O_2$-sensor is differentiated by the differentiating circuit 28, sharp outputs are obtained as shown in FIG. 6(B). The outputs are converted by the monostable multivibrator 29 to pulses $C_1$ and $C_2$ as shown in FIG. 6(C). Thus, the output of the $O_2$-sensor may be converted to digital signals without the A/D converter. If the monostable multivibrator 29 is substituted by a bistable multivibrator, one bit output shown in FIG. 6(D) is obtained. The microcomputer 30 operates in dependency on the outputs of the multivibrator to produce air-fuel mixture enriching and diluting pulses. The pulses are fed to the electromagnetic valves 14, 15 through the driver 31. Thus, the air-fuel ratio of the mixture is controlled to the stoichiometric air-fuel ratio.

Figure 7:
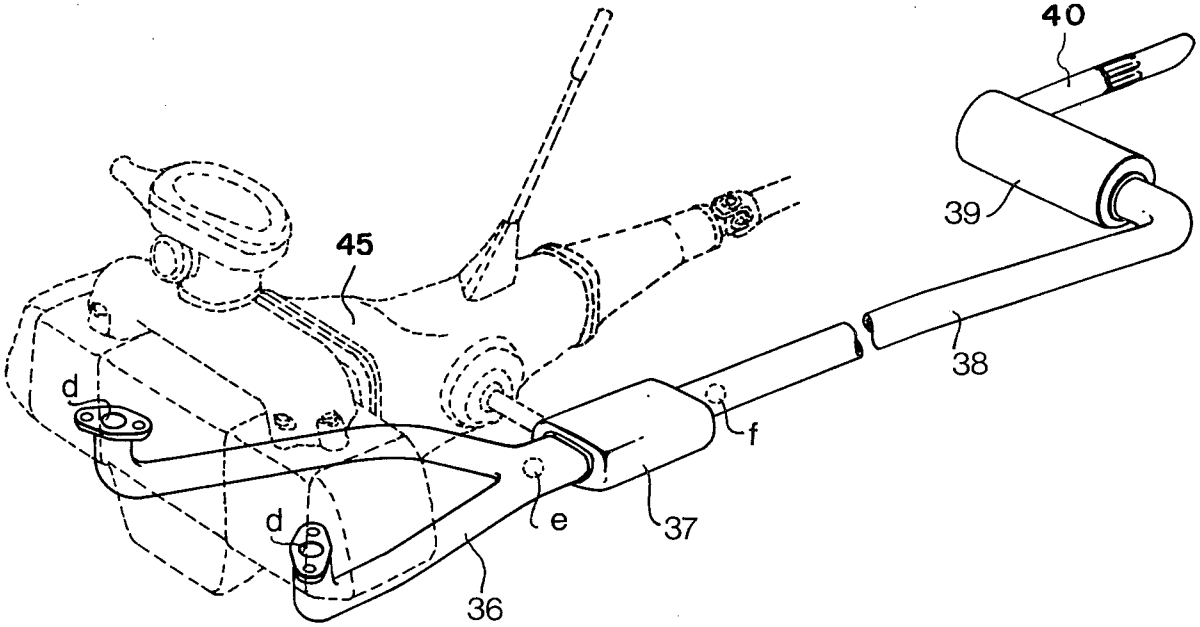
FIG. 7 is a perspective view showing an exhaust system used in an experiment.

Referring to FIG. 7, a power unit 45 used in an experiment of the present invention is an opposed-cylinder type engine. A bifurcated exhaust pipe 36 is connected to exhaust ports of the unit 45 and a catalytic converter 37 is provided at the junction e of the exhaust pipe 36. The $O_2$-sensor is provided at a point f. An exhaust pipe 38 connected to the catalytic converter 37 is connected to a tail pipe 40 via a muffler 39.

The volume of the exhaust passage from inlets d to the junction e is 1500 cc and the volume from d to the $O_2$-sensor position f is 3000 cc. Thus, the volume of the latter is twice as much as the former. The experiment was conducted by positioning the $O_2$-sensor at point f according to the present invention and positioning the $O_2$-sensor at the point e as the conventional system.

FIG. 8(G) shows the output of the $O_2$-sensor positioned at f and FIG. 8(H) shows the output detected at e. It will be seen from the waveforms that noise in the waveforms of the conventional system is decreased in the waveforms of the present invention. Thus, the filter used in the conventional system can be eliminated.

From the foregoing it will be understood that the present invention provides an air-fuel control system by a microcomputer without a filter and an A/D converter.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an internal combustion engine having an exhaust passage, a carburetor for the engine, an electromagnetic valve for correcting the air-fuel ratio of air-fuel mixture supplied to said engine, an $O_2$-sensor for detecting oxygen concentration of exhaust gases, a catalytic converter in said exhaust passage, and a feedback control circuit responsive to the output of said $O_2$-sensor for producing signals for driving said electromagnetic valve for correcting the air-fuel ratio, the improvement wherein said $O_2$-sensor is provided in said exhaust passage at a position downstream of said catalytic converter, and wherein said position is such that the volume of said exhaust passage from an inlet of the exhaust passage to said position is substantially twice as much as the volume from said inlet to an inlet of said catalytic converter, and said feedback control circuit comprises a differentiating circuit means for differentiating the output of said $O_2$-sensor, a multivibrator means responsive to the output of said differentiating circuit means for generating output pulses, and a microcomputer means operating in dependency on the output pulses of said multivibrator means for producing outputs for operatively actuating said electromagnetic valve.

2. The air-fuel ratio control system for an internal combustion engine according to claim 1, wherein said multivibrator means is a monostable multivibrator.

3. The air-fuel ratio control system for an internal combustion engine according to claim 1, wherein said multivibrator means is a bistable multivibrator.

4. The air-fuel ratio control system for an internal combustion engine according to claim 1, further wherein said feedback control circuit includes a driver between said microcomputer means and said electromagnetic valve.

* * * * *